US006230355B1

(12) United States Patent
Harada

(10) Patent No.: US 6,230,355 B1
(45) Date of Patent: May 15, 2001

(54) LINGUAL TOOTHBRUSH

(76) Inventor: Stephen D. Harada, 614 Blair Ave., Piedmont, CA (US) 94611

( * ) Notice: Subject to any disclaimer, the term of this patent is extended or adjusted under 35 U.S.C. 154(b) by 0 days.

(21) Appl. No.: 09/224,961

(22) Filed: Jan. 4, 1999

(51) Int. Cl.[7] ..... A46B 9/04
(52) U.S. Cl. ..... 15/167.1; 15/DIG. 5
(58) Field of Search ..... 15/167.1, 167.2, 15/DIG. 5; D4/104, 105, 110, 113

(56) References Cited

U.S. PATENT DOCUMENTS

| | | | | |
|---|---|---|---|---|
| D. 44,997 | | 12/1913 | Carroll . | |
| D. 47,669 | | 8/1915 | Hunt . | |
| D. 56,858 | | 1/1921 | Cahill . | |
| D. 73,245 | | 8/1927 | Straehly . | |
| D. 77,115 | | 12/1928 | Mowry . | |
| D. 96,749 | | 7/1935 | Hellonen . | |
| D. 107,228 | | 11/1937 | Goodman . | |
| D. 139,264 | * | 10/1944 | Littig | 15/167.1 |
| D. 140,438 | * | 2/1945 | Cohen | 15/167.1 |
| D. 160,604 | | 1/1950 | Hutson . | |
| D. 175,894 | | 10/1955 | Krueger . | |
| D. 189,414 | | 12/1960 | Kisky . | |
| D. 251,038 | | 2/1979 | Hill et al. . | |
| D. 252,597 | | 8/1979 | Holzwarth et al. . | |
| D. 259,977 | | 7/1981 | Porper . | |
| D. 265,527 | | 7/1982 | Macaluso . | |
| D. 282,603 | | 2/1986 | Piero . | |
| D. 289,231 | | 4/1987 | Fleisher . | |
| D. 289,704 | | 5/1987 | Marthaler et al. . | |
| D. 292,948 | | 12/1987 | Parina . | |

(List continued on next page.)

FOREIGN PATENT DOCUMENTS

| | | | | |
|---|---|---|---|---|
| 19816098 | | 10/1999 | (DE) . | |
| 285121 | * | 10/1988 | (EP) | 15/167.1 |
| 723 | * | of 1880 | (GB) . | |
| 17732 | * | of 1885 | (GB) . | |
| 7787 | * | of 1886 | (GB) . | |
| 53-30970 | | 3/1976 | (JP) . | |
| 60-60937 | | 4/1985 | (JP) . | |
| 8-214945 | | 8/1996 | (JP) . | |

OTHER PUBLICATIONS

Weldon Owen Pry Ltd., "Great Inventions", Time–Life Books, 1995, Richard Wood—Consulting Editor, p. 9.

*Primary Examiner*—Terrence R. Till
(74) *Attorney, Agent, or Firm*—Holland & Knight LLP

(57) ABSTRACT

A toothbrush (200, 1000) includes a handle (205, 1005), a head (201, 1001) and an arrangement of bristles (207, 1007) projecting outwardly from a bristle-bearing surface (209, 1009) of the head. Each bristle includes a projecting portion and terminates in a tip end. The bristles include a middle group (217, 1017) and two end groups (218, 219; 1018, 1019). The middle group is disposed between the two end groups and separates the two end groups. The tip ends of the middle group of bristles lie substantially in a common plane to define a brushing surface (301) overlying a substantial portion of the bristle-bearing surface of the head. The lengths of the projecting portions of the bristles in the end groups decrease substantially as a distance increases between the middle group and respective ones of the bristles in the end groups. In a preferred embodiment, at least some bristles in each end group are sufficiently short and rigid to reduce the tendency of the bristles in the middle group to flatten upon contact with the teeth, thereby improving cleaning efficacy of the toothbrush. A curved or angled neck (203, 1003) may also be included to improve maneuverability of the toothbrush in the mouth.

3 Claims, 5 Drawing Sheets

U.S. PATENT DOCUMENTS

| | | | | |
|---|---|---|---|---|
| D. 300,990 | * | 5/1989 | Jagger | D4/104 |
| D. 301,399 | * | 6/1989 | Kreyer | D4/105 |
| D. 305,385 | | 1/1990 | Schneider . | |
| D. 311,454 | | 10/1990 | Rethman . | |
| D. 321,092 | | 10/1991 | Woll et al. . | |
| D. 337,201 | | 7/1993 | Haddad . | |
| D. 342,160 | | 12/1993 | Curtis et al. . | |
| D. 344,414 | | 2/1994 | Rahman . | |
| D. 351,732 | | 10/1994 | Dair et al. . | |
| D. 368,804 | * | 4/1996 | Yost et al. | D4/104 |
| D. 370,347 | | 6/1996 | Heinzelman et al. . | |
| D. 414,938 | | 10/1999 | Von Stein . | |
| 1,494,448 | | 5/1924 | Sookne . | |
| 1,968,303 | * | 7/1934 | McMath | 15/167.1 |
| 2,051,687 | * | 8/1936 | Dressler | 15/167.1 |
| 2,111,880 | | 3/1938 | Waters . | |
| 2,685,703 | * | 8/1954 | Dellenbach | 15/167.1 |
| 2,697,239 | * | 12/1954 | Funk | 15/167.1 |
| 2,864,111 | | 12/1958 | Rotceig . | |
| 2,934,776 | * | 5/1960 | Clemens | 15/167.1 |
| 3,103,679 | * | 9/1963 | Clemens | 15/167.1 |
| 3,258,805 | | 7/1966 | Rossnan . | |
| 4,010,509 | * | 3/1977 | Huish | 15/167.1 |
| 4,109,339 | | 8/1978 | Dietrich . | |
| 4,115,894 | * | 9/1978 | Peterson | 15/167.1 |
| 4,185,349 | | 1/1980 | Papas . | |
| 4,306,327 | | 12/1981 | Zeski . | |
| 4,463,470 | | 8/1984 | Willis . | |
| 4,667,360 | | 5/1987 | Marthaler et al. . | |
| 4,672,706 | | 6/1987 | Hill . | |
| 4,763,375 | * | 8/1988 | Vieten | 15/167.1 |
| 4,800,608 | | 1/1989 | Key . | |
| 5,046,212 | | 9/1991 | O'Conke . | |
| 5,054,154 | | 10/1991 | Schiffer . | |
| 5,114,214 | * | 5/1992 | Barman | 15/DIG. 5 |
| 5,315,730 | * | 5/1994 | Kim et al. | 15/167.1 |
| 5,341,537 | | 8/1994 | Curtis et al. . | |
| 5,369,835 | | 12/1994 | Clarke . | |
| 5,371,915 | | 12/1994 | Key . | |
| 5,383,244 | * | 1/1995 | Ahrens et al. | 15/167.1 |
| 5,392,483 | | 2/1995 | Heinzelman et al. . | |
| 5,481,775 | * | 1/1996 | Gentile et al. | 15/167.1 |
| 5,522,109 | * | 6/1996 | Chan | 15/167.1 |
| 5,570,487 | * | 11/1996 | Schneider | 15/167.1 |
| 5,613,262 | | 3/1997 | Choy-Maldonado . | |
| 5,622,502 | * | 4/1997 | Wilkes et al. | 15/167.1 |
| 5,628,082 | | 5/1997 | Moskovich . | |
| 5,787,540 | * | 8/1998 | Hirschmann | 15/167.1 |
| 5,792,159 | | 8/1998 | Amin . | |
| 5,884,354 | | 3/1999 | Anderson | 15/167.1 |

* cited by examiner

LINGUAL TOOTHBRUSH

FIELD OF THE INVENTION

The invention relates generally to toothbrushes and their methods of fabrication. More particularly, the present invention relates to a toothbrush fabricated to provide effective removal of plague and foreign matter from the lingual, or tongue, side of the teeth and from between teeth when such toothbrush is used by an individual to brush his or her teeth.

BACKGROUND OF THE INVENTION

Toothbrushes of varying shapes and sizes are known for cleaning teeth and dental prosthesis. Typically, a toothbrush includes a rectangular or oval head, a handle, and a neck connecting the handle to the head. The head includes an array of bristles that are ultimately responsible for removing plague and foreign matter from the teeth during brushing. The head (less the bristles), neck, and handle are typically formed as a unitary device through a molding process.

Most often, the head connects to the neck and the neck connects to the handle such that the resulting head, neck, and handle combination are in a relatively straight line along their longitudinal axes. However, in some other embodiments, such as those illustrated in U.S. Design Pat. Nos. 44,997; 47,669; 73,245; 77,115; 175,894; 259,977; and 282,603, the neck and head are oriented perpendicular to each other in the shape of a"T." The handle is typically straight, relatively long and rigid, but in some toothbrush embodiments the handle includes bends or angles either to make the handle more comfortable for a user to hold and/or to improve the toothbrush user's ability to access hard-to-reach surfaces of the teeth.

Toothbrushes of the types described above are effective for cleaning most areas of the teeth or dental prosthesis, but they also have specific limitations. These limitations stem mainly from the fact that bristles, by their nature, clean most effectively when they extend substantially perpendicular to the surface being cleaned. Given the positioning and motion constraints that are present when using devices having long, straight, rigid handles within the confines of the human mouth, a user cannot readily position the bristles of prior art toothbrushes so that maximally effective cleaning can be realized over all areas of the teeth, dental work and gums, especially those areas that are on the lingual, or tongue, side of the teeth. These disadvantages have been ameliorated somewhat by various improvements directed toward improving the maneuverability of toothbrush heads, such as making the head smaller, angling the brush handle and/or the head, providing a flexible joint in the handle and arranging bristles of varying lengths to form tufts having special contours intended to improve their penetration of irregularly shaped structures. Some examples of these improvements are described in U.S. Pat. Nos. 4,463,470; 4,800,608; 5,613,262; and 5,628,082.

However, such improvements are not entirely sufficient to effectively enable cleaning of all areas of the teeth, particularly those areas on the lingual side of the teeth and between teeth. For example, typical prior art toothbrush heads include an array of bristles that extend from a flat surface lying along a single plane that is perpendicular to the longitudinal axis of the bristles. By contrast, the lingual side of the teeth defines a convex curvature. This convex curvature is particularly pronounced at the front, or anterior, portion of the mouth. Therefore, due to such geometric incompatibility, toothbrush heads cannot effectively clean all lingual side anterior tooth surfaces no matter which configuration the neck and head are in (i.e., either straight or T-shaped). In addition, the straight nature of the necks of most toothbrushes makes maneuvering the toothbrush head difficult on the back (i.e., lingual) side of the teeth because the neck bumps into the teeth, deflecting the head of the brush away from proper contact with the lingual surface of the teeth.

To overcome the shortcomings of prior art toothbrush configurations, toothbrush users tend to engage the bristles more forcefully on the lingual surfaces of the teeth in an attempt to more effectively clean the lingual tooth surfaces. However, brushing more forcefully does not necessarily result in cleaner teeth. Bristles clean most effectively when their tips engage the surface being cleaned under a force that lies within a particular range of forces related to the stiffness of the bristles. If the force is not great enough, the bristle tips will not engage the surface being cleaned with sufficient pressure to do an effective a job of cleaning. On the other hand, if the force is too great, the bristles will bend or flatten so as to engage the surface being cleaned with their sides rather than their tips, also resulting in less than optimal cleaning. In addition, depending on the angle of engagement between the bristles and the teeth and the force applied, flattening of some bristles may result in flattening of other bristles due to the proximity of all the bristles on the toothbrush head. For example, when one brushes the lingual side of his or her posterior, or back, teeth, he or she typically angles the toothbrush in an attempt to avoid the anterior teeth and almost inevitably engages the lingual tooth surfaces first with the tips of the bristles at the front end of the toothbrush head. As the force applied to the bristles is increased, the front bristles bend toward the rear of the toothbrush head contacting neighboring bristles and causing the neighboring bristles to likewise bend rearwardly. This domino effect continues affecting all the bristles in such a manner that the bristles engage the tooth surfaces on their sides instead of at their tips. Such side engagement repeats as the person moves the toothbrush head back-and-forth in his or her mouth. As noted above, engaging the tooth surfaces with the sides of the bristles results in less than optimal cleaning.

The above shortcomings of prior art toothbrushes also extend to cleaning between teeth. Bristles clean between teeth most effectively when their tips project between the teeth. However, due to the flat shape of the toothbrush head and the geometry of the toothbrush neck, cleaning between teeth, particularly from the lingual side of the teeth, is difficult. Consequently, toothbrush users typically apply excessive force to the bristles in an attempt to force the tips of the bristles into the spaces between the teeth. Application of excessive force typically results in the tips of the bristles deflecting away from the surface intended to be cleaned and less efficient cleaning occurs.

Therefore, a need exists for a toothbrush and method of fabricating the same that facilitate effective cleaning of the lingual side of the teeth and between teeth, and that permit toothbrush users to have enough confidence when brushing to apply only the appropriate amount of force related to the stiffness of the bristles of their toothbrushes, thereby avoiding excessive force that results in less than optimal cleaning.

SUMMARY OF THE INVENTION

The present invention overcomes the foregoing problems and limitations of the prior art by providing, in one aspect thereof, a toothbrush that includes a head whose bottom (i.e., bristle-bearing) surface and preferably its top (i.e., nonbristle bearing) surface have a convex curvature that complements the geometric shape of a typical human mouth on the lingual side of the teeth. Such a convex curvature, which may be either a smooth continuous curve or a piecewise approximation formed by the angular intersection of two or more planes, approximates the geometric shape of the mouth on the lingual side of the teeth. According to another aspect of the present invention, the toothbrush includes a bristle arrangement in which the bristles project from the bristle-bearing surface of the head by distances appropriate to cause distal ends (i.e., tips) of the bristles to form a generally convex profile that substantially complements the curvature of mouth on the lingual side of the teeth. Thus, the present invention seeks to accommodate the general geometric shape of the mouth on the lingual side of the teeth with a curvature of the bristle-bearing surface of the head, an arrangement of the bristles, or both that generally complement the mouth's shape. By effectively matching the geometric shape of the mouth on the lingual side of the teeth with the shape of the bristle-bearing surface of the head and/or the profile of the bristles, the present invention improves the likelihood that a substantial quantity of bristles will continuously engage the lingual side tooth surfaces at an appropriate angle and force, thereby resulting in improved lingual side cleaning efficacy.

According to yet another aspect of the present invention, the toothbrush further includes a neck having a concave curvature or angling with respect to the brushing surface of the teeth. Such a concave curvature may be either a smooth continuous curve or a segmented approximation formed by the angular intersection of two or more planes. With a concave curvature in the neck, the toothbrush user can more easily, naturally, and reliably maneuver the toothbrush head and bristles on the tongue side of the teeth without interference from the teeth themselves, in contrast to the interference that may be encountered when using straight-necked toothbrushes.

According to a further aspect of the present invention, a toothbrush is provided with a neck and a head oriented in a T-configuration to facilitate easy access to the lingual side of the anterior teeth without requiring the toothbrush user to perform substantial arm and wrist acrobatics to maneuver the toothbrush head behind the anterior teeth. That is, the neck is coupled to a central area of the head such that the longitudinal axis of the head is substantially perpendicular to the longitudinal axis of the neck. In a preferred aspect of the T-configuration toothbrush, the neck is coupled to the head at an angle directed away from the brushing surface. Coupling the head and neck together in this manner effectively results in a slight tilting of the head in an upward direction to accommodate the curvature of either the palate or the bottom part of the mouth, below the tongue.

According to still a further aspect of the present invention, the toothbrush further includes a handle coupled to the neck, wherein the handle preferably includes one or more bends or angles to aid gripping of the toothbrush and maneuvering of the toothbrush in the mouth. Such bending or angling of the handle may be in one plane or in multiple planes.

The present invention further provides a method of fabricating a toothbrush that facilitates improved brushing of a lingual side of the teeth. In one aspect thereof, the method includes the steps of forming a head to have a convex curvature that complements a geometric shape of the mouth on the lingual side of the teeth, and securing a plurality of bristles to the head such that the bristles project outwardly from a surface of the head. According to another aspect thereof, the method of the invention includes the steps of providing a head, providing a bristle arrangement in which the bristles project from a surface of the head by distances appropriate to cause distal ends of the bristles to form a generally convex profile that substantially complements the curvature of mouth on the lingual side of the teeth, and securing the bristles to the head such that the bristles project outwardly from the surface of the head.

These and other aspects and advantages of the invention will become more apparent to a person of ordinary skill in the art upon review of the following detailed description of a preferred embodiment taken in conjunction with the appended drawings in which like reference numerals designate like items.

DETAILED DESCRIPTION OF A PREFERRED EMBODIMENT

Figure 1:
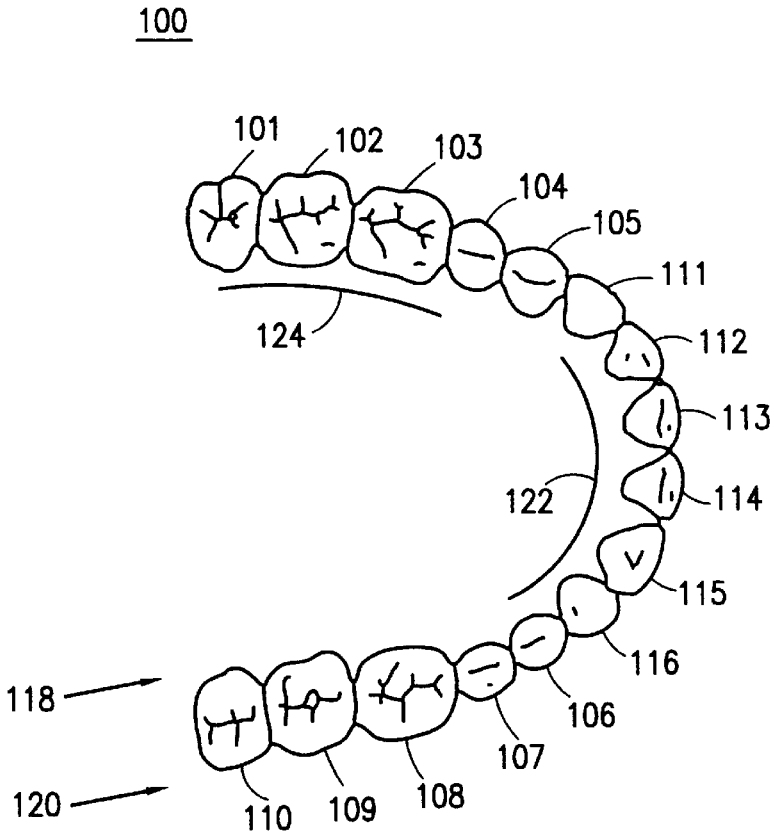
FIG. 1 is a plan view of the arrangement of the teeth on either the upper or lower portion of the human jaw illustrating the geometric shape of the mouth.

FIG. 1 is a plan view of the arrangement of the teeth 101–116 on either the upper or lower portion of the human jaw illustrating the geometric shape of the mouth 100. Each tooth 101–116 is conventionally referred to as having a lingual side 118 and a mutually opposed facial, front or cheek side 120. Teeth 101–110 are generally referred to as posterior or back teeth; whereas, teeth 111–116 are generally referred to as anterior or front teeth. The teeth 101–116 are arranged within the mouth 100 such that the tooth surfaces on the lingual side 118 of the teeth 101–116 define a convex curvature of the mouth 100 with respect to such tooth surfaces as illustrated in FIG. 1. On the other hand, the tooth surfaces on the facial side 120 of the teeth 101–116 define a concave curvature of the mouth 100 with respect to such tooth surfaces. The convex curvature of the mouth 100 on the lingual side 118 of the teeth 101–116 typically varies in degree as groups of teeth 101–116 are traversed, as illustrated by the curved lines 122 and 124. However, an identifiable convex curvature typically exists around the entire lingual side 118 of the mouth 100 in most persons. The degree of convexity is typically most pronounced on the lingual side 118 of the anterior teeth 111–116. Due to this convex curvature, the projection of the teeth 101–116 downwardly or upwardly into the mouth 100 area, and the limited angular opening of the mouth 100, effective brushing of the tooth surfaces on the lingual side 118 of the teeth 101–116 is difficult with prior art toothbrushes. The present invention overcomes the limitations in prior art toothbrushes to provide a toothbrush that facilitates effective cleaning of the lingual side 118 of the teeth 101–116.

Figure 2:
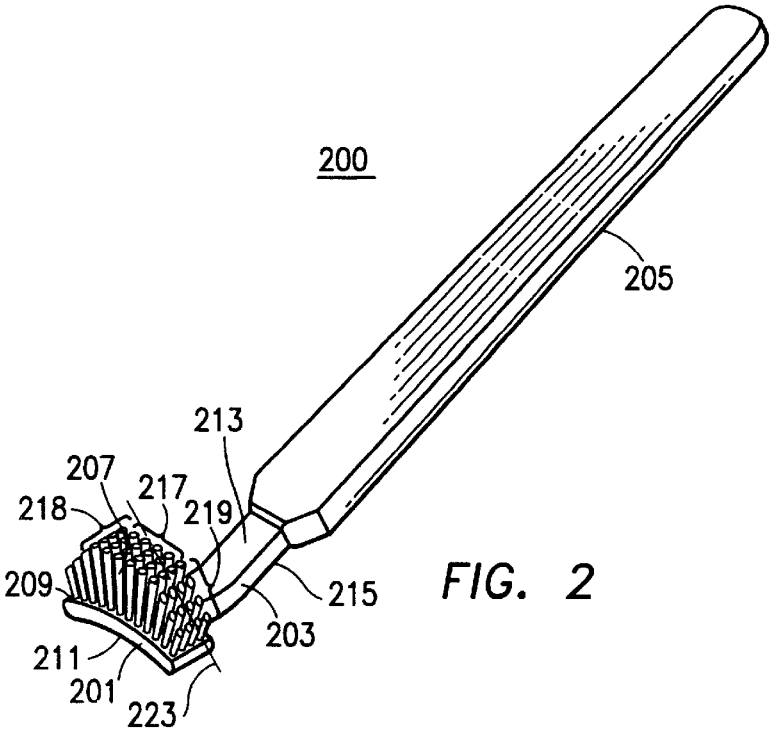
FIG. 2 is a perspective view of a toothbrush in accordance with a first preferred embodiment of the present invention.

FIG. 2 is a perspective view of a toothbrush 200 in accordance with a first preferred embodiment of the present invention. The toothbrush 200 includes a head 201, a neck 203, a handle 205, and a plurality of bristles 207. For clarity of illustration, individual bristles 207 are exaggerated in size. It is to be understood that it would be preferable to include substantially greater numbers of bristles of substantially smaller size diameter than appear to be illustrated. Indeed, what appear in the drawings as individual bristles 207 preferably comprise bundles of bristles, each of which may contain about twenty (20) to about thirty (30) individual bristles of much smaller diameter than those illustrated.

Figure 6:
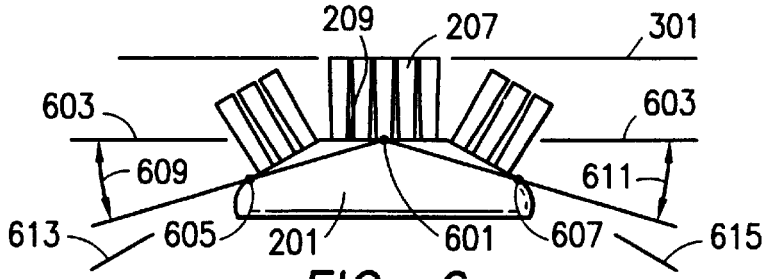
FIG. 6 is a front elevational view of a first alternative embodiment of the head of the toothbrush of either FIG. 2 or FIG. 10.
Figure 7:
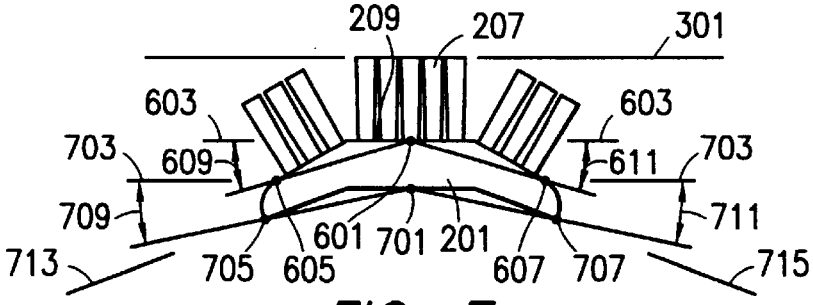
FIG. 7 is a front elevational view of a second alternative embodiment of the head of the toothbrush of either FIG. 2 or FIG. 10.

The head 201 includes a bristle-bearing bottom surface 209 and a mutually opposed top surface 211 spaced apart from the bottom surface 209. According to the invention, at least the bottom surface 209 and preferably both surfaces 209, 211 have convex curvatures as shown with respect to a brushing surface of the teeth (reference numeral 301 in FIG. 3). The curvature of one or both of the bottom surface 209 and the top surface 211 preferably complements the convex curvature of the mouth 100 on the lingual side 118 of the teeth 101–116, such as the curvature 122 present at the anterior region of the mouth 100. The convex curvature of one or both of the bottom surface 209 and the top surface 211 preferably comprises a smooth continuous curve as illustrated in FIG. 2 and FIG. 4, but alternatively may comprise a piecewise or segmented approximation formed by the angular intersection of two or more planes, such as illustrated in FIGS. 6 and 7 and described in more detail below.

The neck 203 includes a bottom surface 213 spaced apart from a top surface 215. Both surfaces 213, 215 of the neck 203 preferably have concave curvatures or angling with respect to the brushing surface of the teeth as described in more detail below. The handle 205 is depicted as being straight, but alternative handle embodiments may be employed, such as those described below with respect to FIGS. 5, 10, 13, and 14.

The head 201, neck 203, and handle 205 are preferably fabricated as a single, integrated unit using well-known injection molding techniques. Thus, upon fabrication, the head 201 is coupled to the neck 203, which in turn is coupled to the handle 205 as shown in FIG. 2.

The bristles 207 project outwardly from the bottom surface 209 of the head 201 and form a generally convex profile that substantially complements the curvature of the mouth 100 on the lingual side 118 of the teeth 101–116. In the preferred embodiment, the bristles 207 form a piecewise linear convex profile as illustrated in FIGS. 2 and 4. In an alternative embodiment, the lengths of the bristles 207 may be such as to form a continuous curve convex profile similar to the convex curvature profiles of the top and bottom surfaces 209, 211 of the head 201 illustrated in FIGS. 2 and 4. In the preferred embodiment, the lengths of the projecting portions of the bristles 207 (i.e., the portions extending from the bottom surface 209 of the head 201 outward) taper such that the projecting portions of those bristles near the center of the head 201 are significantly longer than the lengths of those bristles near each opposing end of the head 201.

In the first preferred embodiment for example, the bristles 207 are divided into three groupings 217–219. The first grouping, middle grouping 217, includes bristles 207 having projecting portions of substantially equal length (e.g., about ten (10) to about twelve (12) millimeters (mm) in length, as measured from the bottom surface 209 of the head 201) and is positioned between the other two groupings, end groupings 218 and 219. The bristles 207 in the end groupings 218, 219 decrease in length, with the longest bristles 207 being directly adjacent the middle grouping 217 and the shortest bristles 207 being at the distal ends of the head 201. In the preferred embodiment, the lengths of the projecting portions of the bristles 207 in the end groupings 218, 219 decrease substantially linearly from the middle grouping 217 to the ends of end groupings 218, 219. For example, as shown in FIG. 2, the lengths of bristles 207 in end grouping 219 preferably decrease linearly (as illustrated by dashed line 223) from the middle grouping 217 to the end of the head 201 to a minimum length of about three (3) to about five (5) mm, as measured from the bottom surface 209 of the head 201.

In alternative embodiments, the bristles 207 may have a variety of taper arrangements provided that the bristles 207 together with the head 201 at least approximately, and preferably closely, correspond in profile to a convex curvature that is complementary in shape to a convex curvature of the mouth 100 on the lingual side 118 of the teeth 101–116, such as curvature 124 or more preferably curvature 122. For example, the bristles 207 may vary in length to collectively form a piecewise or smooth convex curvature with respect to the brushing surface of the teeth, such as when the surfaces 209, 211 of the head 201 are flat, or the bristles 207 may be substantially equal in length provided that the head 201 is arched or curved appropriately to create a bristle profile that complements the convex curvature of the mouth 100 on the lingual side 118 of the teeth 101–116.

The bristles 207 may be secured to the head 201 using any presently known or future developed technique. That is, the process used to secure the bristles 207 to the head 201 is of no import to the present invention. In the preferred embodiment, the bristles 207 are secured to the head 201 in accordance with standard toothbrush manufacturing techniques by first creating a plurality of bores in the head 201, then placing a bundle of bristles 207 into each bore, and finally trimming the bristles 207 to the appropriate lengths, such that the profile of the projecting portions of the bristles 207 is substantially complementary in shape to the convex curvature of the mouth 100 on the lingual side 118 of the teeth 101–116.

Figure 5:
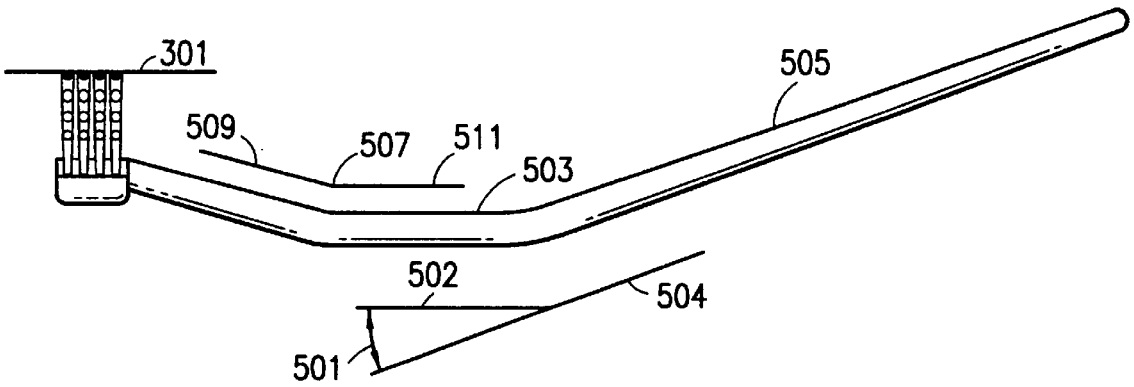
FIG. 5 is a side elevational view of an alternative embodiment of the toothbrush of FIG. 2.
Figure 3:
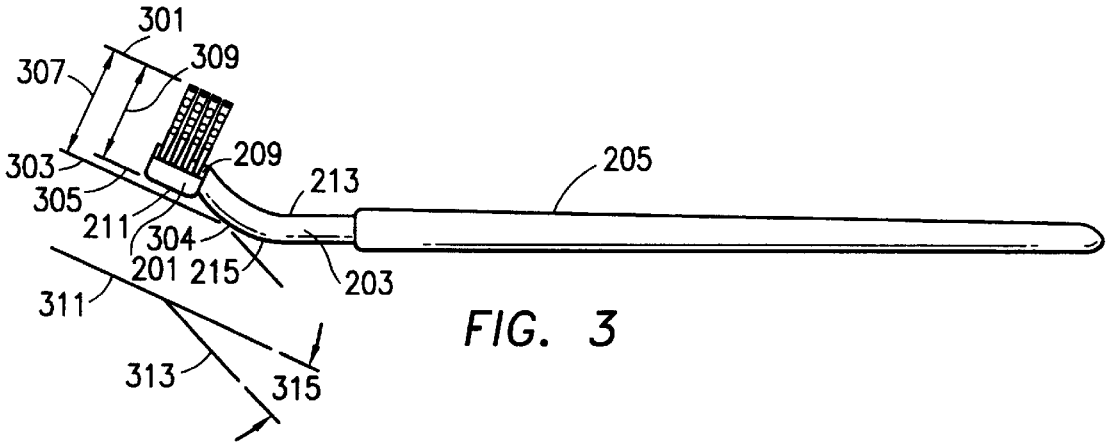
FIG. 3 is a side elevational view of the toothbrush of FIG. 2.
Figure 4:
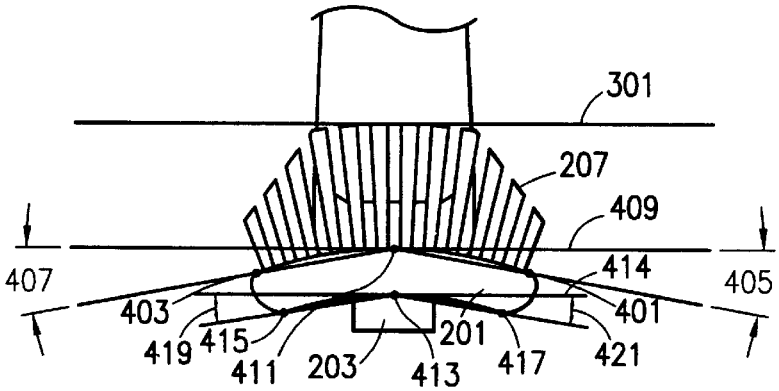
FIG. 4 is a front elevational view of the toothbrush of FIG. 2.

In the first preferred embodiment, the neck 203 is oriented substantially perpendicular to the head 201 and preferably includes a concave curvature with respect to a brushing surface of the teeth 301 as shown in FIG. 3. The bottom surface 213 of the neck 203 is coupled to the bottom surface 209 of the head 201 and the top surface 215 of the neck 203 is coupled to the top surface 211 of the head 201. Similar to the convex curvature of the head 201 and/or profile of the bristles 207, the concave curvature of the neck 203 may be either a smooth continuous curve as depicted in FIG. 3 or a piecewise approximation formed by the angular intersection of two or more planes, such as depicted in FIG. 5.

In the embodiment illustrated in FIG. 3, the concavity of the neck 203 is acute in that a center point 304 of the concave curvature of the top surface 215 of the neck 203 lies in a plane 303 that is substantially parallel to the brushing surface 301 of the teeth and that is farther in distance from the brushing surface 301 than is any plane (e.g., plane 305) containing an end point (see end points 401 and 403 of FIG. 4) of the top surface 211 of the head 201. That is, the concavity of the neck 203 is such that the distance 307 between the brushing surface 301 at the tips of the middle grouping 217 of bristles 207 and the plane 303 containing the center point 304 of the concave curvature of the top surface 215 of the neck 203 is greater than the distance 309 between the brushing surface 301 and any plane (e.g., plane 305) containing an end point of the top surface 211 of the head 201. Such acute concavity of the neck 203 enables the neck 203 to avoid even high profile anterior teeth 111–116 projecting into the mouth area during brushing of the lingual side 118 of the teeth 101–116. By fabricating the neck 203 with a concave curvature or angling to avoid the anterior teeth 111–116, more effective brushing of the lingual side 118 of the anterior teeth 111–116 can be accomplished because deflection of the bristles 207 off of the lingual side tooth surfaces due to contact of the neck 203 with the anterior teeth 111–116 is reduced or eliminated. In alternative embodiments directed toward lower profile teeth, such as teeth of children, the concavity of the neck 203 may be reduced or eliminated altogether while still providing effective cleaning of the lingual side 118 of the teeth 101–116 due to the convex configuration of the head 201 and/or profile of the bristles 207.

The neck 203 is preferably coupled to a central area of the head 201 at an angle directed away from the brushing surface 301 of the teeth. For example, line 311 illustrates a surface in parallel with the brushing surface 301 of the teeth and line 313 illustrates a surface in parallel with the center line of the neck 203 in the area where the neck 203 couples to the head 201. As shown, the neck 203 is directed away from the brushing surface by an angle 315 (preferably in the range of about fifteen (15) to about (30) degrees) at the point where the neck 203 couples to the head 201. By angling the neck 203 away from the brushing surface 301 at the point where the neck 203 couples to or joins the head 201, the head 201 is effectively angled or tilted to generally match the longitudinal profile of the lingual side 118 of the anterior teeth 111–116, thereby facilitating improved bristle engagement and cleaning of the lingual side 118 of the anterior teeth 111–116.

In an alternative embodiment, the neck 203 may be coupled to the head 201 at an angle other than ninety (90) degrees (i.e., other than perpendicular) with respect to the head 201 and/or to areas other than the central area of the head 201. For example, the neck 203 may be coupled to the head 201 at an angle of about forty-five (45) degrees and/or the neck 203 may be coupled off center. The angle of the neck 203 with respect to the head 201 and the location that the neck 203 couples to the head 201 are of less importance in the present invention than is the configuration of the head 201 and/or the arrangement of the bristles 207. Therefore, a variety of neck-to-head coupling configurations may be employed while remaining within the spirit and scope of the present invention.

FIG. 4 is a front elevational view of the toothbrush 200 of FIG. 2 that illustrates the preferred convex curvature of the head 201. As depicted in this view, a center point 411 of the bottom surface 209 of the head 201 lies in a plane 409 that is substantially parallel to the brushing surface 301 of the teeth. The bottom surface 209 is curved such that end points 401 and 403 of the bottom surface 209 are positioned at respective angles 405, 407 from about fifteen (15) to about forty-five (45) degrees with respect to the plane 409 containing the center point 411 of the bottom surface 209. Similarly, a center point 413 of the top surface 211 of the head 201 lies in a plane 414 that is substantially parallel to the brushing surface 301 of the teeth. The top surface 211 is curved such that end points 415 and 417 of the top surface 211 are positioned at respective angles 419, 421 from about fifteen (15) to about forty-five (45) degrees with respect to the plane 414 containing the center point 413 of the top surface 211.

In the first preferred toothbrush 200, the angles 405 and 407 are preferably identical (i.e., the curvature is preferably symmetric about center point 411) at a value in the range of about fifteen (15) to about twenty-five (25) degrees and the angles 419 and 421 are preferably identical (i.e., the curvature is also preferably symmetric about center point 414) at a value in the range of about fifteen (15) to about twenty-five (25) degrees. In alternative embodiments, the curvature may not be symmetric. Moreover, the geometric shape of the head 201 need not be curved as long as the combined shape of the head 201 and the profile of the bristles 207 correspond generally to the geometric shape of the mouth 200 on the lingual side 118 of the teeth 101–116. For example, the head 201 might be fabricated to match the polygonal profile of the preferred bristle arrangement (e.g., a flat center portion and end portions that angle away from the brushing surface 301 at angles in the range of about fifteen (15) to about forty-five (45) degrees), as shown in FIGS. 6 and 7 and described in more detail below. Alternatively, the head 201 may be rectangular or oval provided that the profile of the bristles 207 generally corresponds to the shape of the mouth 100 on the lingual side 118 of the teeth 101–116.

FIG. 5 is a side elevational view of an alternative embodiment of the toothbrush 200 of FIG. 2. In this embodiment, the neck 503 is longer than in FIG. 2 and includes a piecewise or segmented approximation of a concave curvature with respect to the brushing surface 301 of the teeth 101–116 formed by the angular intersection 507 of two planes 509, 511. In addition, the handle 505 is bent or angled toward the brushing surface 301 of the teeth 101–116. Angling of the handle 505 toward the brushing surface 301 allows the person using the toothbrush to reach the lingual side 118 of the anterior teeth 111-116 without requiring the person to maneuver the toothbrush as much as when the handle 505 is straight. In a preferred embodiment, the angle 501 formed by the plane 502 containing the section of the neck 503 coupled to the handle 505 and the plane 504 containing the handle 505 itself is in the range of about ten (10) to about twenty-five (25) degrees.

FIG. 6 is a front elevational view of a first alternative embodiment of the head 201 of the toothbrush 200 of FIG. 2. In this embodiment, the bottom surface 209 of the head 201 is a piecewise or segmented approximation of the convex curvature of the lingual side 118 of the teeth 101–116 formed by the angular intersections of three planes 603, 613, 615. The head 201 includes a middle section and two end sections. The middle section includes a center point 601 that lies in plane 603. The first end section includes end point 605 and the second end section includes end point 607. The end sections taper off from the middle section such that the shape of the bottom surface 209 of the head 201 corresponds generally to the shape of the curvature of the mouth 100 on the lingual side 118 of the teeth 101–116. Preferably, end point 605 is positioned at an angle 609 ranging from about fifteen (15) to about forty-five (45) degrees with respect to plane 603. Similarly, end point 607 is preferably positioned at an angle 611 ranging from about fifteen (15) to about forty-five (45) degrees with respect to plane 603.

FIG. 7 is a front elevational view of a second alternative embodiment of the head 201 of the toothbrush 200 of FIG. 2. In this embodiment, not only is the bottom surface 209 of the head fabricated to correspond generally to the shape of the mouth 100 on the lingual side 118 of the teeth 101–116 as in the alternative embodiment described above with respect to FIG. 6, but the top surface 211 of the head 201 is also so fabricated. Thus, the top surface 211 of the head 201 is a piecewise or segmented approximation of the convex curvature of the lingual side 118 of the teeth 101–116 formed by the angular intersections of three planes 703, 713, 715. Similar to the bottom surface 209, the top surface 211 includes a middle section and two end sections. The middle section includes a center point 701 that lies in plane 703, which is preferably parallel to plane 603. The first end section includes end point 705 and the second end section includes end point 707. The end sections taper off from the middle section such that the shape of the top surface 211 of the head 201 corresponds generally to the shape of the curvature of the mouth 100 on the lingual side 118 of the teeth 101–116. Preferably, end point 705 is positioned at an angle 709 ranging from about fifteen (15) to about forty-five (45) degrees with respect to plane 703. Similarly, end point 707 is preferably positioned at an angle 711 ranging from about fifteen (15) to about forty-five (45) degrees with respect to plane 703.

Figure 8:
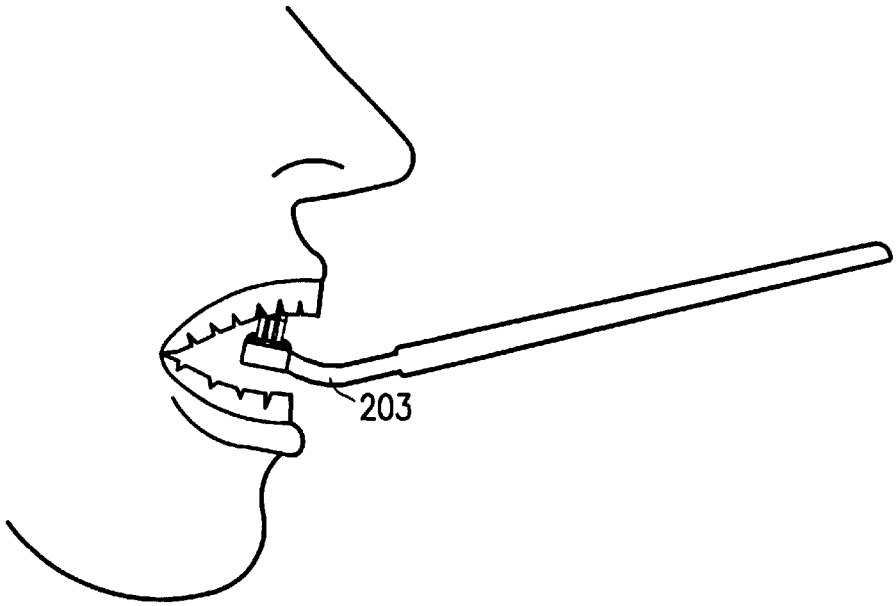
FIG. 8 is a side view of a person's head showing the toothbrush of FIG. 2 in use.

FIG. 8 is a side view of a person's head showing the toothbrush 200 of FIG. 2 in use. As shown, the preferred concave curvature of the neck 203 allows relatively easy access of the head 201 to the lingual side 118 of the anterior teeth 111–116. In addition, the concave curvature of the neck 203 enables the neck 203 to avoid contact with the anterior teeth 111–116 during brushing (provided, of course, that the mouth is open), thereby allowing the bristles to remain in contact with the lingual tooth surfaces.

Figure 9:
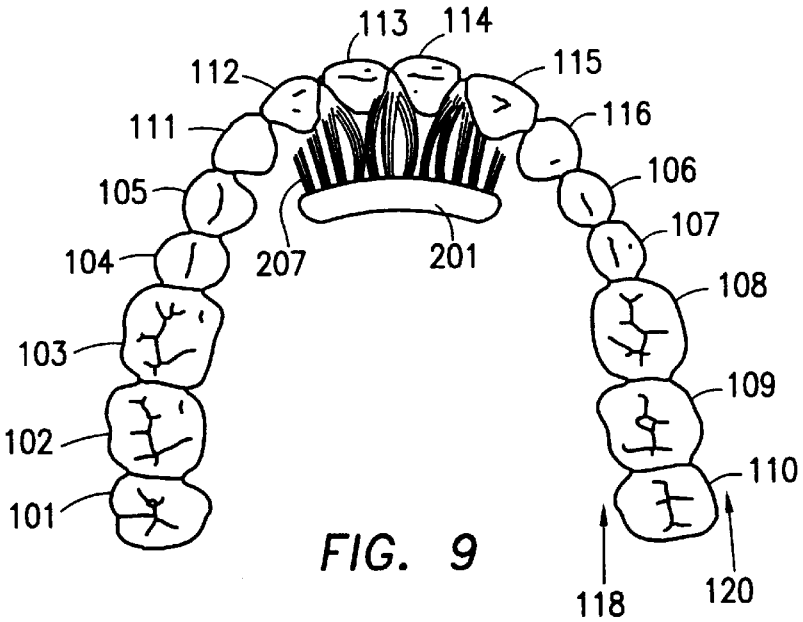
FIG. 9 is a plan view of the mouth illustrating the head of the toothbrush of FIG. 2 in use.

FIG. 9 is a plan view of the mouth 100 illustrating the head 201 of the toothbrush 200 of FIG. 2 in use. As described above, the preferred convex curvature of the head 201 substantially corresponds to the curvature of the mouth 100 on the lingual side 118 of the anterior teeth 111–116, thereby allowing the bristles 207 to remain engaged with the lingual side tooth surfaces of the anterior teeth 111–116 during brushing. In addition, the preferred bristle arrangement allows the bristles 207 to remain relatively straight as force is applied to the head 201 and the head 201 is moved up and down and side-to-side. Further, the shorter, stiff end bristles 218, 219 of the preferred bristle arrangement project between the anterior teeth 111–116 as force is applied to the head 201, thereby providing improved cleaning of the interproximal (i.e., between teeth) tooth surfaces.

As described above with respect to FIGS. 2–9, the present invention provides a toothbrush 200 fabricated to effectively clean the lingual side tooth surfaces of the anterior teeth 111–116 during brushing of such teeth by a user. By fabricating the head 201 of the toothbrush 200 and/or the overall profile of the bristles 207 to complement at least approximately, and preferably closely, the shape of the mouth 100 on the lingual side 118 of the teeth 101–116, the present invention increases the probability that, on average, more bristles 207 will remain in contact with the lingual side tooth surfaces during brushing, thereby improving the cleaning efficacy of the toothbrush 200. By further including a concave curvature of the neck 203, the preferred toothbrush 200 facilitates easy access of the head 201 to the lingual side tooth surfaces and reduces the likelihood that the neck 203 will contact the anterior teeth 111–116 during brushing, thereby further increasing the probability that the bristles 207 will remain in contact with the lingual side tooth surfaces during brushing. Still further, by angling the neck 203 away from the brushing surface 301, thereby effectively tilting the head 201, the preferred toothbrush 200 increases the likelihood of bristle contact with the lingual tooth surfaces along the entire length of each tooth without requiring complex maneuvering of the toothbrush 200 to do so.

Figure 10:
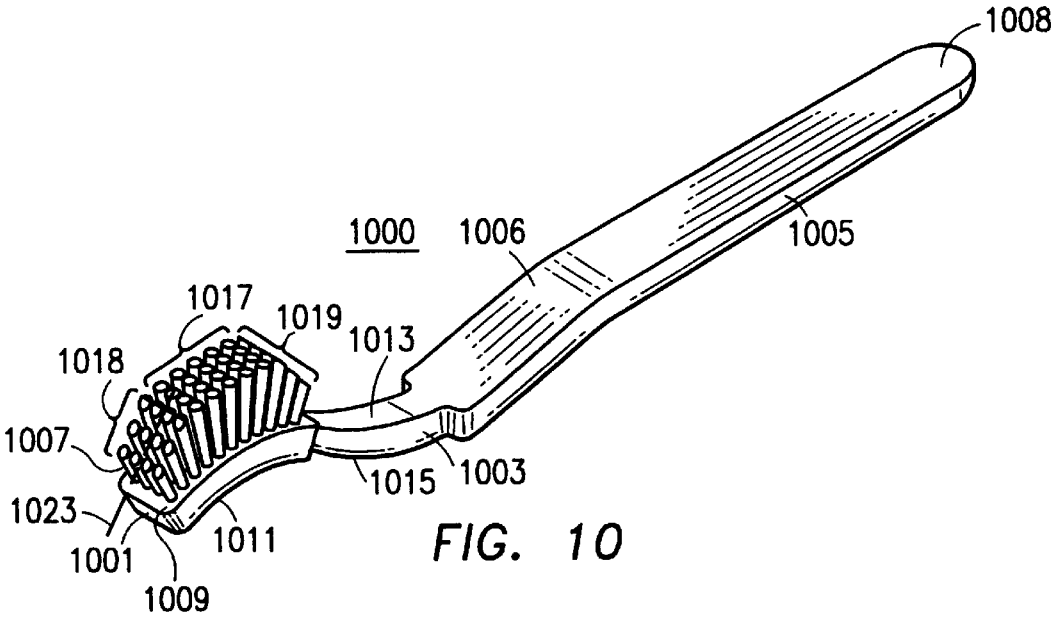
FIG. 10 is a perspective view of a toothbrush in accordance with a second preferred embodiment of the present invention.

FIG. 10 is a perspective view of a lingual toothbrush 1000 in accordance with a second preferred embodiment of the present invention. Similar to the toothbrush 200 of FIG. 2, the toothbrush 1000 of FIG. 10 includes a head 1001, a neck 1003, a handle 1005, and a plurality of bristles 1007. However, in contrast to the toothbrush 200 of FIG. 2, the neck 1003 of toothbrush 1000 is coupled to one end of the head 1001 instead of to the central area of the head 1001. In addition, the longitudinal axis of the neck 1003 is collinear with the longitudinal axis of the head 1001, in contrast to the perpendicular or angular orientation of the neck 203 and the head 201 shown in FIG. 2.

The head 1001 includes a bottom surface 1009 spaced apart from a top surface 1011, wherein both surfaces 1009, 1011 preferably have smooth and continuous convex curvatures with respect to a brushing surface of the teeth. The neck 1003 includes a bottom surface 1013 spaced apart from a top surface 1015, wherein both surfaces 1013, 1015 preferably have smooth and continuous concave curvatures with respect to the brushing surface of the teeth.

The handle 1005 preferably includes two segments: a straight segment 1006 and an angled segment 1008. The straight segment 1006 is approximately one-third the total length of the handle 1005 and the angled segment 1008 is approximately two-thirds the total length of the handle 1005. The straight segment 1006 is connected to the neck 1003 in the same manner as if the entire handle 1005 was straight. The angled segment 1008 is connected to the straight segment 1006 and bends away from the brushing surface of the teeth at an angle preferably ranging from about ten (10) to about twenty (20) degrees with respect to a plane containing the straight segment 1006. In an alternative embodiment, the handle 1005 may be straight (e.g., as is the handle 205 depicted in FIG. 2) or may be configured in the manner described above with respect to FIG. 5 or below with respect to FIGS. 13 and 14. The head 1001, neck 1003, and handle 1005 are preferably fabricated as a single, integrated unit using well-known injection molding techniques.

Figure 11:
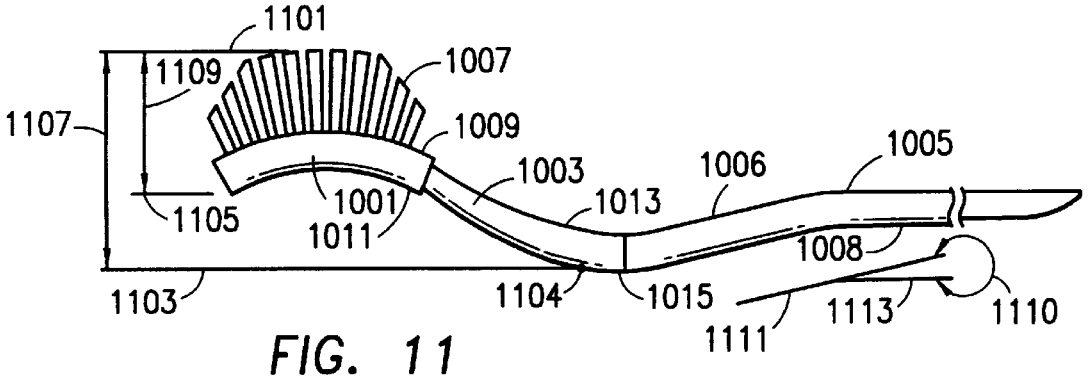
FIG. 11 is a side elevational view of the toothbrush of FIG. 10.

In the second preferred embodiment, as in the first preferred embodiment, the bristles 1007 project outward from the bottom surface 1009 of the head 1001 and form a generally convex profile that substantially complements the curvature of the mouth 100 on the lingual side 118 of the teeth 101–116. In the preferred embodiment, the bristles 1007 form a piecewise linear convex profile as illustrated in FIGS. 10 and 11. In an alternative embodiment, the lengths of the bristles 1007 may be such as to form a continuous convex profile similar to the convex curvature profiles of the top and bottom surfaces 1009, 1011 of the head 1001 illustrated in FIGS. 10 and 11. In the preferred embodiment, the lengths of the projecting portions of the bristles 1007 (i.e., the portions extending from the bottom surface 1009 of the head 1001 outward) taper such that the projecting portions of those bristles 1007 near the center of the head 1001 are significantly longer than the lengths of those bristles 1007 near each opposing end of the head 1001.

In the second preferred embodiment for example, the bristles 1007 are divided into three groupings 1017–1019. The first grouping, middle grouping 1017, includes bristles of substantially equal length (e.g., about ten (10) to about (12) mm in length, as measured from the bottom surface 1009 of the head 1001) and is positioned between the other two groupings, end groupings 1018 and 1019. The bristles 1007 in the end groupings 1018, 1019 decrease in length, with the longest bristles 1007 being directly adjacent the middle grouping 1017 and the shortest bristles 1007 being at the distal ends of the head 1001. In the preferred embodiment, the lengths of the bristles 1007 in the end groupings 1018, 1019 decrease substantially linearly from the middle grouping 1017 to the ends of end groupings 1018, 1019. For example, as shown in FIG. 10, the lengths of bristles in end grouping 1018 preferably decrease linearly (as illustrated by dashed line 1023) from the middle grouping 1017 to the end of the head 1001 to a minimum length of about three (3) to about five (5) mm, as measured from the bottom surface 1009 of the head 1001.

In alternative embodiments, the bristles 1007 may have a variety of taper arrangements provided that the bristles 1007 together with the head 1001 at least approximately, and preferably closely, correspond in profile to a convex curvature that is complementary in shape to a convex curvature of the mouth 100 on the lingual side 118 of the teeth 101–116. For example, the bristles 1007 may vary in length to collectively form a piecewise or smooth convex curvature with respect to the brushing surface of the teeth, such as when the surfaces 209, 211 of the head 201 are flat, or the bristles 207 may be substantially equal in length provided that the head 201 is arched or curved appropriately to create a bristle profile that complements the convex curvature of the mouth 100 on the lingual side 118 of the teeth 101–116.

The bristles 1007 may be secured to the head 1001 using any presently known or future developed technique. That is, the process used to secure the bristles 1007 to the head 1001 is of no import to the present invention. In the preferred embodiment, the bristles 1007 are secured to the head 1001 in accordance with standard toothbrush manufacturing techniques by first creating a plurality of bores in the head 1001, then placing a bundle of bristles 1007 into each bore, and finally trimming the bristles 1007 to the appropriate lengths, such that the profile of the projecting portions of the bristles 1007 is substantially complementary in shape to the convex curvature of the mouth 100 on the lingual side 118 of the teeth 101–116.

In the second preferred embodiment, as noted above, the neck 1003 is oriented in the same general direction (i.e., along the same longitudinal axis) as the head 201 and preferably includes a concave curvature with respect to a brushing surface 1101 of the teeth as shown in FIG. 11. The bottom surface 1013 of the neck 1003 is coupled to the bottom surface 1009 of the head 1001 and the top surface 1015 of the neck 1003 is coupled to the top surface 1011 of the head 1001.

In the illustrated embodiment, the concavity of the neck 1003 is acute in that a center point 1104 of the concave curvature of the top surface 1015 of the neck 1003 lies in a plane 1103 that is substantially parallel to the brushing surface 1101 of the teeth and that is farther in distance from the brushing surface 1101 than is any plane (e.g., plane 1105) containing an end point of the top surface 1011 of the head 1001. That is, the concavity of the neck 1003 is such that the distance 1107 between the brushing surface 1101 at the tips of the middle grouping of bristles 1017 and the plane 1103 containing the center point 1104 of the concave curvature of the top surface 1015 of the neck 1003 is greater than the distance 1109 between the brushing surface 1101 and any plane (e.g., plane 1105) containing an end point of the top surface 1011 of the head 1001. Such acute concavity of the neck 1003 enables the neck 1003 to avoid even high profile anterior teeth 111–16 projecting into the mouth area during brushing of the lingual side 118 of the teeth 101–16.

By fabricating the neck 1003 with a continuous or segmented (e.g., piecewise) concave curvature to avoid the anterior teeth 111–16, more effective brushing of the lingual side 118 of the posterior teeth 101–110 can be accomplished because deflection of the bristles 1007 off of the lingual side tooth surfaces due to contact of the neck 1003 with the anterior teeth 111–116 is reduced or eliminated. In addition, the concave curvature of the neck 1003 permits the toothbrush user to reach lower on the lingual side 118 of a posterior tooth 101–110 than does a typical toothbrush in the event that the user has lower, lingual side posterior tooth gum recession. In alternative embodiments directed toward lower profile teeth, such as teeth of children, the concavity of the neck 1003 may be reduced or eliminated altogether while still providing effective cleaning of the lingual side 118 of the teeth 101–116 due to the complementary configuration of the head 1001 and/or the profile of the bristles 1007 with respect to the geometric shape of the mouth 100 on the lingual side 118 of the teeth 101–116.

In an alternative embodiment, the head 1001 might be a shape other than convex, provided that the shape of the head 1001 in combination with the overall profile of the bristles 1007 at least approximately, and preferably closely, complements the shape of the mouth 100 on the lingual side 118 of the teeth 101–116. For example, the head 1001 may have the shape of either embodiment described above with respect to FIGS. 6 and 7. Alternatively, the surfaces of the head 1001 may be flat (similar to typical prior art toothbrushes) provided that the shape of the head 1001 in combination with the overall profile of the bristles 1007 have the general shape of the mouth 100 on the lingual side 118 of the teeth 101–116.

As noted above with respect to FIG. 10, the preferred handle 1005 of the second preferred embodiment of the toothbrush 1000 includes a straight segment 1006 and an angled segment 1008. The angle 11 10 formed by the plane 1111 containing the straight segment 1006 of the handle 1005 and the plane 1113 containing the angled segment 1008 of the handle 1005 is preferably in the range of about ten (10) to about twenty (20) degrees. Angling of the handle 1005 in this manner allows the user to reach the lingual side 118 of the posterior teeth 101–110 without requiring the user to maneuver the toothbrush 1000 as much as when the handle 1005 is straight.

Figure 12:
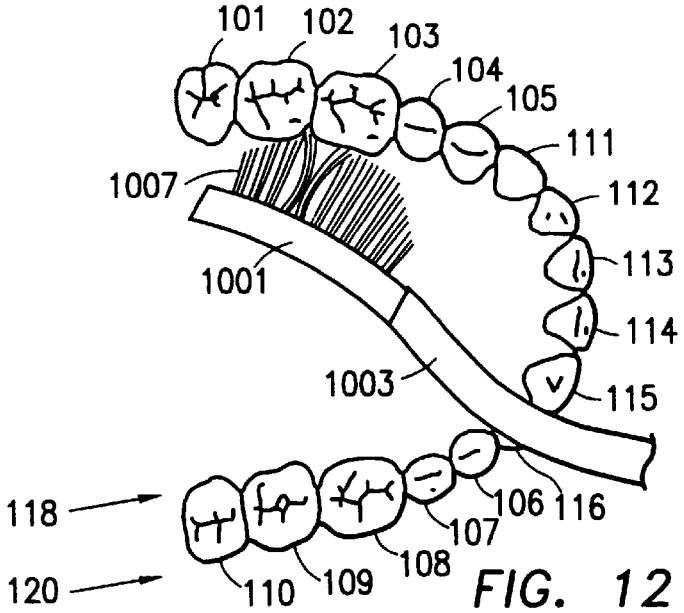
FIG. 12 is a plan view of the mouth illustrating the head of the toothbrush of FIG. 10 in use.

FIG. 12 is a plan view of the mouth 100 illustrating the head 1001 of the toothbrush 1000 of FIG. 10 in use. As described above, the preferred convex curvature of the head 1001 substantially corresponds to the curvature of the mouth 100 on the lingual side 118 of the teeth 101–116, thereby allowing the bristles 1007 to remain engaged with the lingual side tooth surfaces of the teeth 101–116 during brushing. In addition, the preferred bristle arrangement allows the bristles 1007 to remain relatively straight as force is applied to the head 1001 and the head 1001 is moved up and down and side-to-side. When the user first inserts the head 1001 in the mouth 100, the shorter bristles of end grouping 1018 contacts the lingual tooth surfaces. As the user applies pressure during brushing and moves the head 1001 back and forth, the initial contact with the shorter bristles of end grouping 1018 guides the follow through contact of the longer bristles of middle grouping 1017. As the longer bristles of middle grouping 1017 contact the lingual tooth surfaces, cleaning efficacy is improved by the decreased flattening of the longer bristles due to the rigidity and support provided by the shorted bristles of end groupings 1018 and 1019. That is, since end grouping 1018 includes short, rigid bristles, the bristles of end grouping 1018 do not bend into the middle grouping 1017 upon first contact of the bristles of end grouping 1018 with the tooth surfaces. Since the bristles of end grouping 1018 do not bend into the bristles of middle grouping 1017, the bristles of middle grouping 1017 contact the tooth surfaces with their tips instead of their sides, thereby providing improved cleaning effect. In addition, since the bristles of end grouping 1019 are also short and rigid, they limit the bending of the bristles of middle grouping 1017 as the head 1001 is pushed against and across the teeth 101–116, thereby improving the amount of bristle tip contact maintained on the tooth surfaces during brushing.

Besides enabling the long bristles of the middle grouping 1017 to clean effectively, the shorter, stiff bristles of the end groupings 1018, 1019 project between the teeth 101–116 as pressure is applied to the head 1001, thereby providing improved cleaning of the interproximal tooth surfaces. Finally, although the above description has focused on the present invention's lingual side cleaning efficacy, the toothbrush 1000 of FIG. 10 also provides effective cleaning of the facial surfaces of the teeth 101–116 for many of the same reasons that it provides effective cleaning of the lingual surfaces. Consequently, the toothbrush 1000 of FIG. 10, and its various embodiments, can be used for effective, daily dental hygiene.

Figure 13:
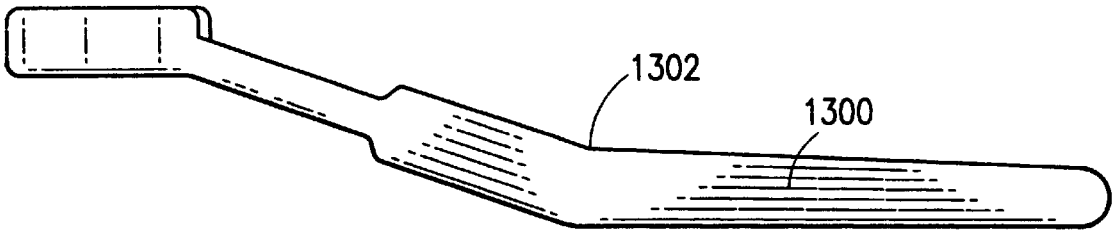
FIG. 13 is a plan view of a first alternative embodiment of the toothbrush of FIG. 10.
Figure 14:
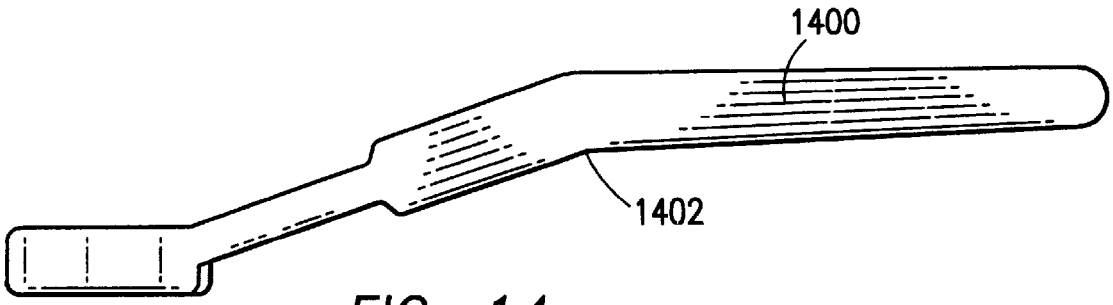
FIG. 14 is a plan view of a second alternative embodiment of the toothbrush of FIG. 10.

FIGS. 13 and 14 are plan views of alternative embodiments of the toothbrush 1000 of FIG. 10. The handle 1300 in FIG. 13 includes a bend 1302 or angle that facilitates holding of the toothbrush by a left-handed person. By contrast, the handle 1400 in FIG. 14 includes a bend 1402 or angle that facilitates holding of the toothbrush by a right-handed person. The bends 1302, 1402 in the handles 1300, 1400 allow the handles 1300, 1400 to rest more comfortably in the hands of the users and, therefore, facilitate more comfortable use of the toothbrush 1000. In addition to the embodiments illustrated in FIGS. 13 and 14, the handles 205, 1005 might alternatively be angled toward the brushing surface 301, 1101, for example, as shown in FIG. 5, or away from the brushing surface 301, 1101, for example, as shown in FIG. 11. One of ordinary skill in the art can envision a variety of handle configurations to include with the preferred and alternative embodiments of the toothbrushes 200, 1000 described herein. All such handle configurations are intended to fall within the spirit and scope of the present invention.

In addition to various handle embodiments, the toothbrush 1000 of FIG. 10 may be fabricated with a variety of embodiments of the neck 1003. In the preferred embodiment discussed above, the neck 1003 is fabricated to include an acute, continuous concave curvature with respect to the brushing surface 1101. However, in an alternative embodiment, such as one for use with low profile (e.g., children's) teeth, the concave curvature or angling may be less acute (e.g., as shown in FIG. 5) or the neck 1003 may even be straight.

As described above with respect to FIGS. 10–14, the present invention provides a toothbrush 1000 fabricated to effectively clean all tooth surfaces of the teeth during brushing of such teeth by an individual. With its head 1001 and/or bristle arrangement contoured to complement the geometric shape of the mouth 100 on the lingual side 118 of the teeth 101–116, the toothbrush 1000 is particularly effective for cleaning the lingual side 118 of the teeth and gums in contrast to its prior art counterparts. In addition, the toothbrush 1000 is also very effective for cleaning the facial side of the teeth and gums and, therefore, is a toothbrush that may be used in everyday dental hygiene.

While the foregoing constitute certain preferred and alternative embodiments of the present invention, it is to be understood that the invention is not limited thereto and that in light of the present disclosure, various other embodiments will be apparent to persons skilled in the art. For example, angles similar to the angles in the handles 1300, 1400 of FIGS. 13 and 14 or curves may be included in the neck 203, 1003 of either toothbrush 200, 1000 to make the toothbrush 200, 1000 more comfortable to use for left-handed or right-handed persons, respectively. Accordingly, it is to be recognized that changes can be made without departing from the scope of the invention as particularly pointed out and distinctly claimed in the appended claims which shall be construed to encompass all legal equivalents thereof.

I claim:

1. A toothbrush comprising:

a head having a longitudinal axis;

a handle having a longitudinal axis, said head being coupled to said handle such that said longitudinal axis of said handle is substantially perpendicular to said longitudinal axis of said head; and a plurality of bristles secured to said head, each of said bristles having a projecting portion which extends outwardly from a surface of said head and terminates at a tip end, said plurality of bristles including a first group of bristles, a second group of bristles and a middle group of bristles, said middle group being disposed between said first group and said second group, and separating said first group from said second group, each tip end of said middle group lying substantially in a common plane to define a brushing surface overlying a substantial portion of said surface of said head, and lengths of projecting portions of said bristles in said first group and said second group decreasing substantially as a distance increases between said middle group and respective ones of said bristles in said first group and said second group, at least some of said bristles in said first group and at least some of said bristles in said second group being sufficiently short and rigid to reduce a tendency of said bristles in said middle group to flatten upon contact with the teeth, thereby improving cleaning efficiency of the toothbrush.

2. The toothbrush of claim 1, wherein said head is oval.

3. The toothbrush of claim 1, wherein lengths of projecting portions of said bristles in said middle group range from about ten millimeters to about twelve millimeters and wherein lengths of projecting portions of said bristles in each of said first group and said second group decrease substantially linearly to respective minimum lengths of about three millimeters to about five millimeters.

* * * * *